US012422207B2

(12) United States Patent
Puha

(10) Patent No.: US 12,422,207 B2
(45) Date of Patent: Sep. 23, 2025

(54) DETACHABLE AMMUNITION MAGAZINE

(71) Applicant: EIGHT HOLDINGS LLC, Coeur D'Alene, ID (US)

(72) Inventor: Teodor Puha, Coeur D'Alene, ID (US)

(73) Assignee: EIGHT HOLDINGS LLC, Coeur D'Alene, ID (US)

( * ) Notice: Subject to any disclaimer, the term of this patent is extended or adjusted under 35 U.S.C. 154(b) by 0 days.

(21) Appl. No.: 18/738,237

(22) Filed: Jun. 10, 2024

(65) Prior Publication Data

US 2024/0410665 A1 Dec. 12, 2024

Related U.S. Application Data

(60) Provisional application No. 63/472,589, filed on Jun. 12, 2023.

(51) Int. Cl.
*F41A 9/70* (2006.01)
*F41A 9/55* (2006.01)

(52) U.S. Cl.
CPC . *F41A 9/70* (2013.01); *F41A 9/55* (2013.01)

(58) Field of Classification Search
CPC ..... F41A 9/24; F41A 9/65; F41A 9/70; F41A 9/64
See application file for complete search history.

(56) References Cited

U.S. PATENT DOCUMENTS 2,205,967 A * 6/1940 Charles ..... F41A 9/65 285/916
2,715,789 A * 8/1955 Garand ..... F41A 9/65 42/50
3,747,249 A * 7/1973 Ouellette ..... F41A 9/70 89/33.17
3,805,434 A 4/1974 Sudano
4,524,672 A * 6/1985 Balsavage ..... F41A 9/70 89/34
4,867,039 A * 9/1989 Dobbins ..... F41C 7/02 89/146
5,056,252 A * 10/1991 Velezis ..... F41A 9/62 42/49.02
5,099,595 A 3/1992 Chesnut
5,309,660 A * 5/1994 Blackamore ..... F42B 33/14 42/106
6,293,040 B1 9/2001 Luth
7,533,483 B1 5/2009 Alzamora
(Continued)

FOREIGN PATENT DOCUMENTS

EP 3514473 A1 7/2019

OTHER PUBLICATIONS

U.S. Appl. No. 61/990,326, filed May 8, 2014.

*Primary Examiner* — Derrick R Morgan
(74) *Attorney, Agent, or Firm* — Eric B. Fugett; Mark A. Pitchford; Pitchford Fugett, PLLC

(57) ABSTRACT

An ammunition magazine for a firearm includes a magazine body defining an interior space in which a plurality of cartridges is receivable, a follower in the interior space configured to bias the cartridges toward an upper end of the magazine body, and a catch on the magazine body configured to hold a topmost cartridge received in the interior space in a substantially horizontal position within the upper end of the magazine body until an advancing bolt of the firearm pushes the topmost cartridge toward a firing chamber of the firearm.

19 Claims, 8 Drawing Sheets

(56) References Cited

U.S. PATENT DOCUMENTS

| | | | | |
|---|---|---|---|---|
| 8,393,107 | B2 | 3/2013 | Brown | |
| 8,448,364 | B2 | 5/2013 | Davidson | |
| 8,839,709 | B1 | 9/2014 | Crye | |
| 9,857,132 | B2 * | 1/2018 | Ballard | F41A 9/70 |
| 10,605,553 | B1 * | 3/2020 | Collazo | F41C 7/00 |
| 11,326,846 | B1 * | 5/2022 | Alon | F41A 9/70 |
| 11,662,166 | B2 * | 5/2023 | Overstreet | F41A 9/70 42/50 |
| 12,209,837 | B1 * | 1/2025 | Madden | F41A 9/83 |
| 12,281,868 | B2 * | 4/2025 | Zeider | F41A 9/65 |
| 2012/0117840 | A1 * | 5/2012 | Chewning | F41A 9/70 42/49.01 |
| 2013/0025177 | A1 | 1/2013 | Bovensiep | |
| 2014/0075808 | A1 * | 3/2014 | Ballard | F41A 9/65 42/49.01 |
| 2014/0230297 | A1 | 8/2014 | Larson, Jr. | |
| 2014/0237878 | A1 | 8/2014 | Lambert | |
| 2014/0259844 | A1 * | 9/2014 | Kruse | F41A 9/70 42/50 |
| 2015/0113848 | A1 | 4/2015 | Monveldt | |
| 2015/0176938 | A1 | 6/2015 | Micklethwaite | |
| 2015/0192384 | A1 * | 7/2015 | Ballard | F41A 9/70 42/71.01 |
| 2015/0267982 | A1 * | 9/2015 | Emde | F41A 9/70 42/17 |
| 2016/0327353 | A1 | 11/2016 | DiChario | |
| 2016/0327354 | A1 | 11/2016 | DiChario | |
| 2017/0067715 | A1 | 3/2017 | Conant | |
| 2017/0314886 | A1 | 11/2017 | Huang | |
| 2019/0226776 | A1 | 7/2019 | DiChario | |
| 2019/0226779 | A1 * | 7/2019 | DiChario | F41A 9/71 |
| 2020/0292263 | A1 * | 9/2020 | Underwood | F41A 9/83 |
| 2021/0341241 | A1 * | 11/2021 | Roberts | F41A 9/65 |
| 2023/0168053 | A1 * | 6/2023 | Underwood | F41A 9/70 42/50 |
| 2023/0288155 | A1 * | 9/2023 | Underwood | F41A 17/38 |
| 2024/0361095 | A1 * | 10/2024 | Brown | F41A 9/70 |
| 2024/0410665 | A1 * | 12/2024 | Puha | F41A 9/70 |
| 2025/0102252 | A1 * | 3/2025 | Puha | F41A 9/55 |

* cited by examiner

DETACHABLE AMMUNITION MAGAZINE

CROSS-REFERENCES TO RELATED APPLICATIONS

This non-provisional patent application claims priority to U.S. Provisional Patent Application Ser. No. 63/472,589, filed Jun. 12, 2023 and titled "TABLESS MAGAZINE FOR A FIREARM," the entire disclosure of which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

The present invention relates generally to ammunition magazines, and more particularly, to detachable ammunition magazines for firearms.

Numerous removable box-type ammunition magazines for modern rifles, handguns, and shotguns are known. However, most currently available magazines are not designed to hold the uppermost cartridge in a proper position for smooth and consistently reliable loading into the firing chamber of the firearm. Instead, traditional magazines tend to position cartridges, especially cartridges with a generally flat front surface (e.g, shotgun shells or "shotsbells") at too large (i.e., high) of an angle relative to the path of the bolt of the firearm and the barrel bore. Cartridges which it at too large or high of an angle relative to the path of the bolt and the barrel bore can interfere with cycling of the firearm during ejection of a fired cartridge case and loading of each subsequent cartridge. Another related consequence of a cartridge being positioned within a magazine at too steep an angle is that cartridges can easily fall out of the magazine if the magazine is inadvertently dropped on the ground or otherwise jostled.

U.S. Pat. No. 10,941,995 discloses a detachable magazine for a shotgun firearm that includes a feed ramp and two pairs of forward and rearward feed lips to position a shotshell for loading. However, the two pairs of spaced feed lips used on this magazine do not physically block a shotshell received therein from being inadvertently knocked out of the magazine.

Accordingly, what is needed are improvements in detachable ammunition magazines for firearms and other projectile launching weapons.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Features of the presently disclosed invention overcome or minimize some or all of the identified deficiencies of the prior art, as will become evident to those of ordinary skill in the art after a study of the information presented in this document.

It is an object of the present invention to provide a detachable ammunition magazine for a firearm which automatically positions and holds a topmost cartridge received therein in a substantially horizontal position until an advancing bolt of the firearm pushes the topmost cartridge toward a firing chamber of the firearm. Ammunition magazines disclosed herein are designed to hold the topmost cartridge in the correct position for reliable and smooth loading into the firing chamber of the firearm, which also advantageously prevents the topmost cartridge from interfering with ejection of a previously fired cartridge case. Ammunition magazines disclosed herein are also configured to prevent cartridges from falling out of the magazine body when a loaded magazine is dropped or otherwise jostled.

Accordingly, in one aspect, the invention provides an ammunition magazine comprising a magazine body defining an interior space in which a plurality of cartridges is receivable, a follower in the interior space configured to bias the cartridges toward an upper end of the magazine body, and a catch on the magazine body configured to hold a topmost cartridge received in the interior space in a substantially horizontal position within the upper end of the magazine body until an advancing bolt of the firearm pushes the topmost cartridge toward a firing chamber of the firearm.

Numerous other objects, advantages and features of the present disclosure will be readily apparent to those of skill in the art upon a review of the following drawings and description of exemplary embodiments.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified. In the drawings, not all reference numbers are included in each drawing, for the sake of clarity.

DETAILED DESCRIPTION

Figure 1:
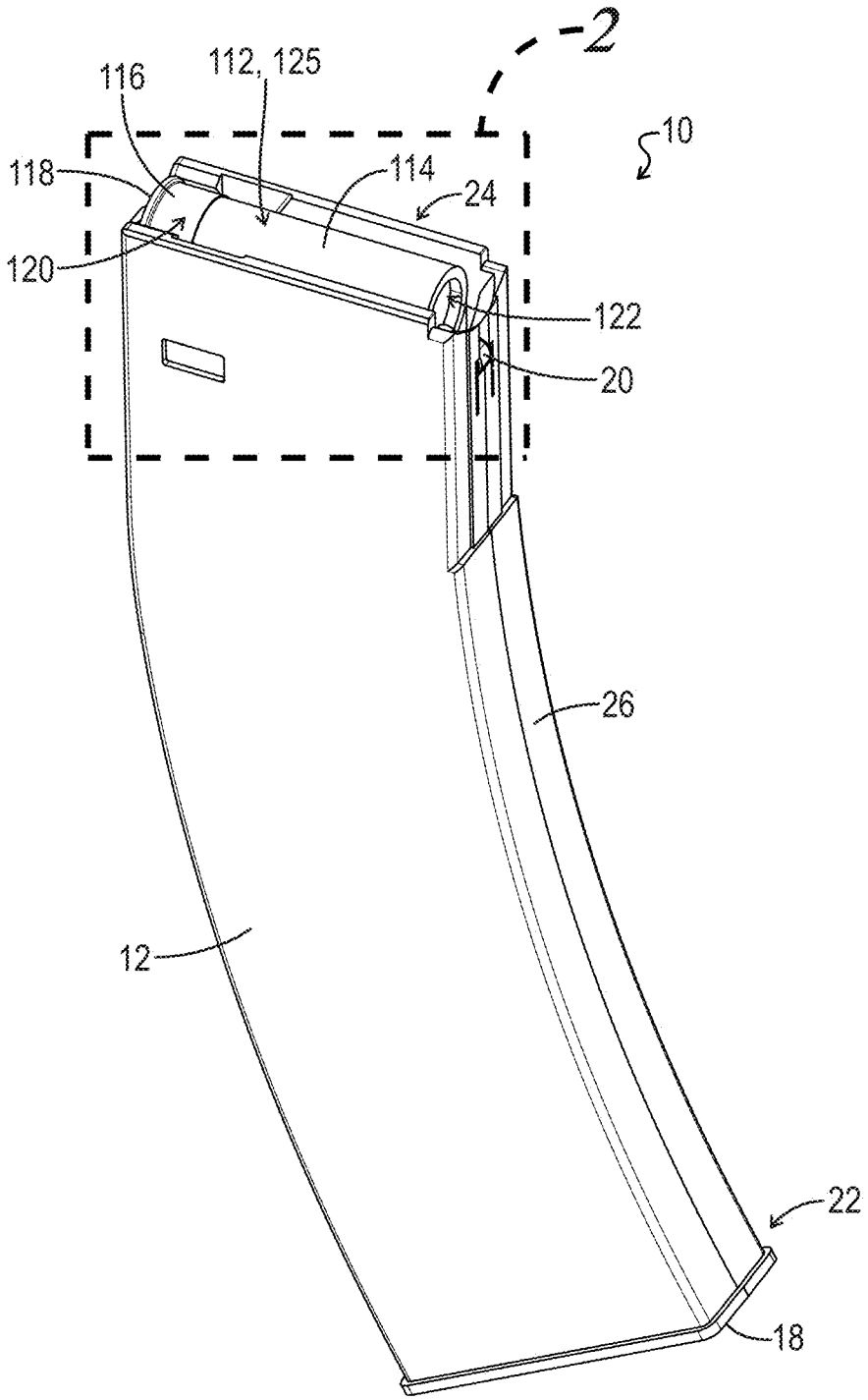
FIG. 1 is an elevated front right side perspective view of an embodiment of a detachable ammunition magazine for a firearm conducted in accordance with the present invention.
Figure 2:
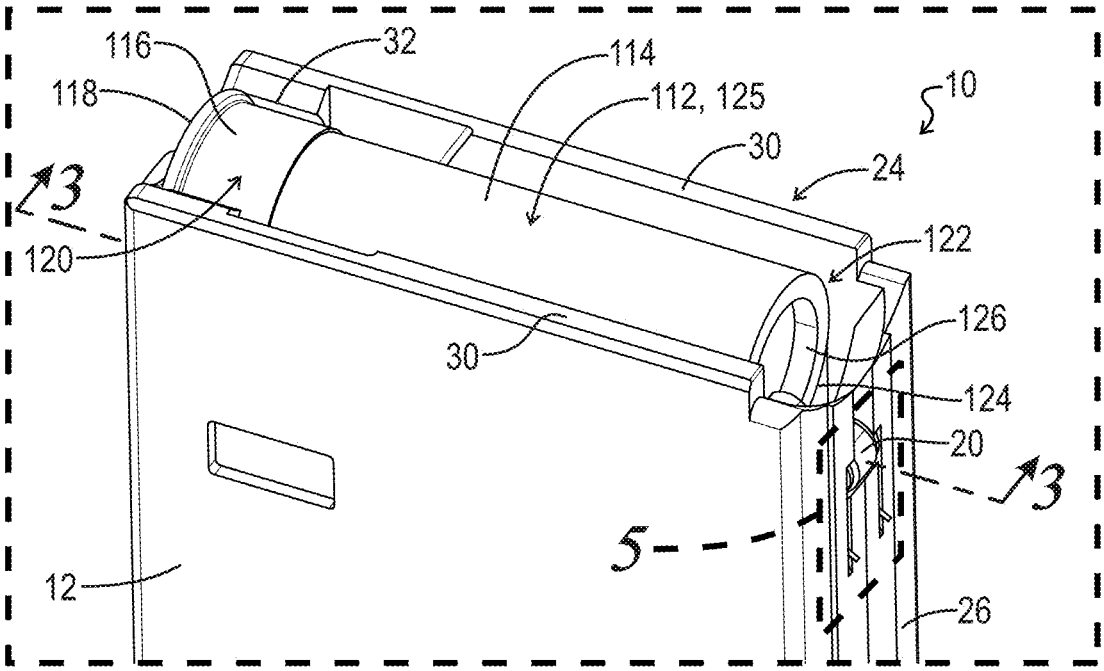
FIG. 2 is magnified detail view of location 2 of FIG. 1.
Figure 3:
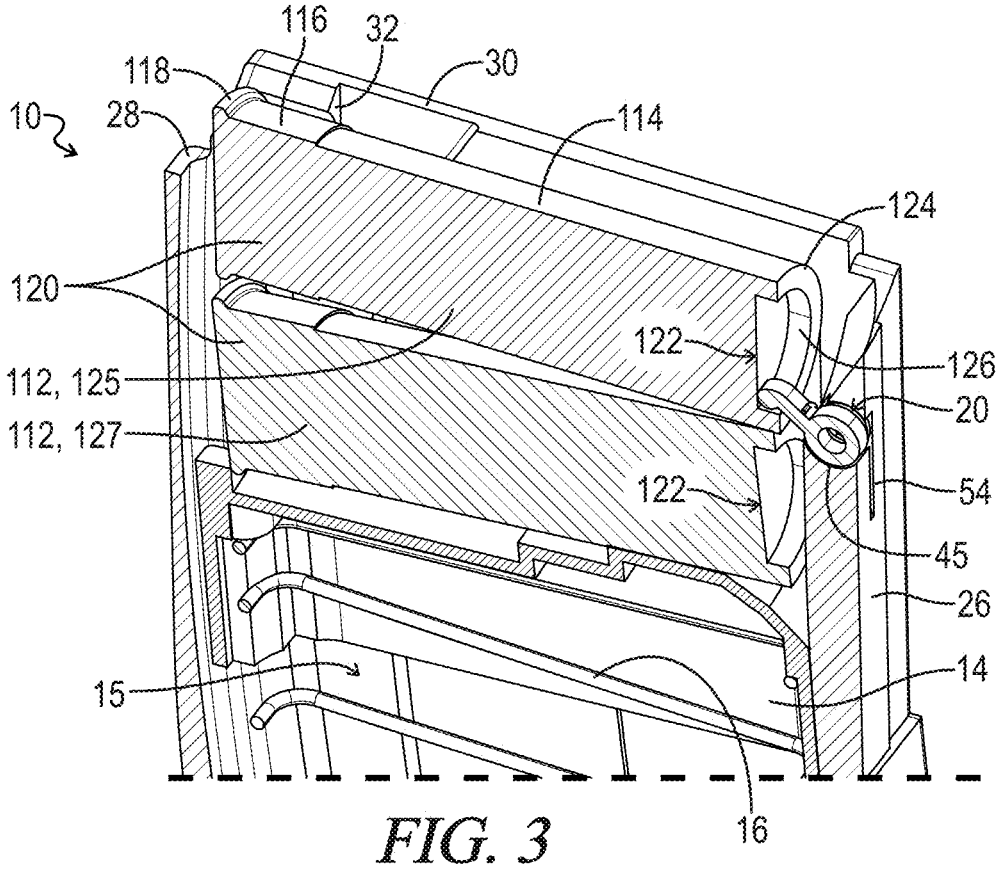
FIG. 3 is a sectional view taken along line 3-3 of FIG. 2.

The details of one or more embodiments of the present invention are set forth in this document. Modifications to embodiments described in this document, and other embodiments, will be evident to those of ordinary skill in the art after a study of the information provided herein. The information provided in this document, and particularly the specific details of the described exemplary embodiment(s), is provided primarily for clearness of understanding and no unnecessary limitations are to be understood therefrom. In case of conflict, the specification of this document, including definitions, will control.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

While the terms used herein are believed to be well understood by one of ordinary skill in the art, a number of terms are defined below to facilitate the understanding of the embodiments described herein. Unless defined otherwise, all technical and scientific terms used herein have the same meaning as commonly understood by one of ordinary skill in the art to which the subject matter disclosed herein belongs. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an "upright" position is considered to be the position of apparatus components while in proper operation or in a natural resting position as described and shown herein. The upright firing position of a firearm is a generally level firing position. "Vertical," "horizontal," "above," "below," "side," "top," "bottom," "upper," "lower," and other orientation terms are described with respect to this upright position during operation, unless otherwise specified, and are used to provide an orientation of embodiments of the invention to allow for proper description of example embodiments. A person of skill in the art will recognize, however, that the apparatus can assume different orientations when in use.

As used herein, the terms "front" and "forward" means in a direction extending toward the muzzle of the firearm. In some cases, the term "forward" can also mean forward beyond the muzzle of the firearm. The terms "aft" and "rear" means in a direction extending away from the muzzle of the firearm toward a rear end of a firearm. In some cases, the term "rearward" can also mean rearward beyond the rear end of the firearm.

The term "when" is used to specify orientation for relative positions of components, not as a temporal limitation of the claims or apparatus described and claimed herein unless otherwise specified.

The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments.

All measurements should be understood as being modified by the term "about" regardless of whether the word "about" precedes a given measurement.

The terms "significantly", "substantially", "approximately", "about", "relatively," or other such similar terms that may be used throughout this disclosure, including the claims, are used to describe and account for small fluctuations, such as due to variations in manufacturing or processing from a reference or parameter. Such small fluctuations include a zero fluctuation from the reference or parameter as well. For example, they can refer to less than or equal to ±10%, such as less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%. In some instances, the term "substantially" as used herein can mean what is considered normal or possible within the limits of applicable industry-accepted manufacturing practices and tolerances.

All references to singular characteristics or limitations of the present disclosure shall include the corresponding plural characteristic(s) or limitation(s) and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

The methods and devices disclosed herein, including components thereof, can comprise, consist of, or consist essentially of the essential elements and limitations of the embodiments described herein, as well as any additional or optional components or limitations described herein or otherwise useful.

Referring now generally to FIGS. 1-13, there is depicted an embodiment of a detachable ammunition magazine 10 for a firearm 100. The firearm 100 includes a lower receiver 102 defining a magazine well 104 in which the magazine 10 is receivable, an upper receiver 106 attached to the lower receiver 102, a barrel assembly 105 defining a firing chamber 108 attached to the upper receiver 106, a bolt carrier group 110 carrying a bolt 111 housed within the upper receiver 106 that reciprocates back and forth to push (i.e., load) cartridges 112 from the magazine 10 into the firing chamber 108 and subsequently eject spent cartridge cases 114.

In the embodiment depicted herein, the firearm 100 is the AR-platform shotgun firearm disclosed in U.S. Pat. No.

10,605,553 and the cartridges 112 are shotgun cartridges (i.e., shotshells). Accordingly, the cartridges 112 depicted herein include a case 114, a case head 116 defining a rim 118 at a rear portion 120 of each cartridge, and a front portion 122 having a forward edge 124 and a crimp or lip 126. Although the firearm 100 and cartridges 112 are exemplified herein by a shotgun firearm 100 and shotshells 112, respectively, it is to be understood that the novel detachable ammunition magazine 10 disclosed herein can be used with other kinds of ammunition and projectile launching devices designed to accept detachable magazines (whether AR-platform or not), including but not limited to rifles, handguns, air guns, and grenade launchers, as well as ammunition for each of the foregoing weapons, including rimmed and rimless brass or polymer cased ammunition, monolithic air gun slugs, grenades, and the like, which include a similar structure on a front end thereof similar to the lip 126 of cartridges 112. Non-limiting examples of ammunition usable with the magazine 10 include shotshells and hollow point cartridges. Consequently, the term "firearm" as used herein means any device which expels one or more projectiles through a barrel using combustion of a chemical propellant or the release of a mechanically compressed gas.

The ammunition magazine 10 includes a magazine body 12 having an open upper end 24 and a lower end (i.e., bottom) 22, a follower 14, a follower spring 16, a base 18 closing the lower end 22, and a cartridge catch 20 at the open upper end 24. The body 12 defines an interior space 15 in which a plurality of cartridges 112 is receivable. The follower 14 and follower spring 16 are received in the interior space 15. The spring 16 pushes against the base 18 to bias the follower 14 and any cartridges 112 received against and riding atop the follower 14 in the interior space 15 toward the upper end 24. The base 18 can be removable from or permanently attached to the lower end 22 of the magazine body 12.

Cartridges 112 received in the interior space 15 are stacked atop one another on the follower 14. Cartridges 112 can be arranged in the interior space 15 in a single stack (as depicted) or a double stacked orientation. Regardless of orientation and number of cartridges received in the magazine 10, the terms "topmost cartridge" and "following cartridge" are used herein to refer to the two uppermost cartridges 125, 127 received in the interior space 15. To be clear, in use, when the topmost cartridge 125 is loaded from the magazine 10 into the firing chamber 108 of the firearm 100 by the advancing bolt 111 during cycling of the firearm 100, the following cartridge 127 takes the place of topmost cartridge 125 as the follower 14 pushes the following cartridge 127 into the position at the top of the magazine 10 previously occupied by the chambered cartridge 112. As explained in more detail below, the catch 20 is configured to releasably engage the front portion 122 of the topmost cartridge 125. When engaged with the front portion 122 of the topmost cartridge 125, the catch 20 holds the topmost cartridge 125 in a substantially horizontal position 135 within the upper end 24 of the magazine body 12 until an advancing bolt 111 of the firearm 100 pushes the topmost cartridge 125 toward the firing chamber 108 of the firearm 100.

As used herein with reference to the orientation of a topmost cartridge 125 received within the interior space 15 of the magazine body 12, the phrase "substantially horizontal position" means the position of the topmost cartridge 125 as exemplified and best shown in FIGS. 1-3 and 8-9. In some embodiments, the topmost cartridge 125 is in the substantially horizontal position 135 when the topmost cartridge 125 is at an angle 128 of about 15 degrees or less relative to a horizontal reference plane 130 defined by the upper end 24 of the magazine body 12. In some specific embodiments, the topmost cartridge 125 is in the substantially horizontal position 135 when the topmost cartridge 125 is at an angle 128 of about 10 degrees or less relative to the horizontal reference plane 130. In some even more specific embodiments, the topmost cartridge 125 is in the substantially horizontal position 135 when the topmost cartridge 125 is at an angle 128 of about 5 degrees or less relative to the horizontal reference plane 130. In one embodiment, the topmost cartridge 125 is in the substantially horizontal position 135 when the topmost cartridge 125 is substantially parallel to the horizontal reference plane 130.

By holding the topmost cartridge 125 in the substantially horizontal position within the upper end 24 of the magazine body 12, magazines 10 constructed in accordance with the present invention prevent the topmost cartridge 125 received in the interior space 15 from interfering with extraction by the bolt 111 of the case 114 of a preceding discharged cartridge 112 from the firing chamber 114. Holding the topmost cartridge 125 in the substantially horizontal position within the upper end 24 of the magazine body 12 also advantageously ensures reliable and smooth loading of each subsequent topmost cartridge 125 into the firing chamber 114 by the bolt 111. By contrast, a cartridge that is improperly positioned in a magazine (e.g., with the front end of the cartridge pointing upward at an angle greater than 15 degrees relative to a horizontal reference plane defined by the upper end of a magazine) can interfere with rearward movement of the bolt carrier group during extraction and forward movement of the bolt carrier group during loading or chambering. Indeed, a bolt 111 advancing forward toward a cartridge sitting in the magazine at too high of an angle can miss the case head and compress the side of the cartridge case, thereby causing the firearm to jam and potentially rendering the weapon inoperable. Holding the topmost cartridge 125 in the substantially horizontal position 135 within the upper end 24 of the magazine body 12 advantageously eliminates the risk of malfunction during both extraction and chambering.

Referring now to FIGS. 1-6, the upper end 24 of the magazine body 12 includes a forward wall 26, a rear wall 28, opposing sidewalls 30, and a pair of feed lips 32. The rear wall 28 is spaced rearwardly from the forward wall 26. The opposing sidewalls 30 extend between the forward wall 26 and rear wall 28. The forward wall 26 includes a forward interior surface 34. The forward interior surface 34 defines a sloped feed ramp 36 at the upper end 24 of the magazine body 12. A forward edge 124 of the topmost cartridge 125 rides up the feed ramp 36 when the advancing bolt 111 contacts the case head 116 and pushes the topmost cartridge 125 toward the firing chamber 108. The feed lips 32 are on the opposing sidewalls 30.

The feed lips 32 are spaced rearwardly from the feed ramp 36. The feed lips 32 are configured to engage the rear portion 120 of the topmost cartridge 125 at the case head 116. The feed lips 32 retain the rear portion 120 of the topmost cartridge 125 within the upper end 24 of the magazine body 12 until the advancing bolt 111 of the firearm 100 contacts the case head 116 and pushes the topmost cartridge 125 toward the firing chamber 108. The catch 20 is spaced from the pair of feed lips 32. As such, the feed lips 32 can work in conjunction with the catch 20 to hold the topmost cartridge 125 in the substantially horizontal position 135 within the upper end 24 of the magazine body 12 until the advancing bolt 111 pushes the topmost cartridge 125 toward the firing chamber 108.

The catch 20 includes a catch body 40, an arm 42, a head 44, and a spring 46. The arm 42 extends from the catch body 40. The head 44 is at a distal end 48 of the arm 42 opposite the catch body 40. The catch body 40 is rotatably mounted to the forward wall 26 proximate to the feed ramp 36 on the upper end 24 of the magazine body 12. The catch body 40 is received in a cylindrical pocket 45 defined in the forward wall 26. In other embodiments, the catch body 40 can be secured within the pocket 45 and rotatably about a fastener such as a screw or pin (not shown). The arm 42 is biased rearwardly away from the forward wall 26 by the spring 46. More specifically, the arm 42 is biased away from the forward wall 26 and into the interior space 15 such that the head 44 engages the front portion 122 of the topmost cartridge 125 to hold the topmost cartridge 125 in the substantially horizontal position 135. In this way, the catch 20 is biased toward engagement with the front portion 122 of the topmost cartridge 125. The spring 46 can be a double torsion spring 46. The spring 46 rides on the arm 42 where the arm 42 joins the catch body 40. As beset shown in FIG. 4. The head 44 is shaped and sized to engage the front portion 122 of the topmost cartridge 125. More specifically, the head 44 is shaped and sized to engage the crimp or lip 126 of the topmost cartridge 125 when the head 44 engages the front portion 122 of the topmost cartridge 125.

Figure 6:
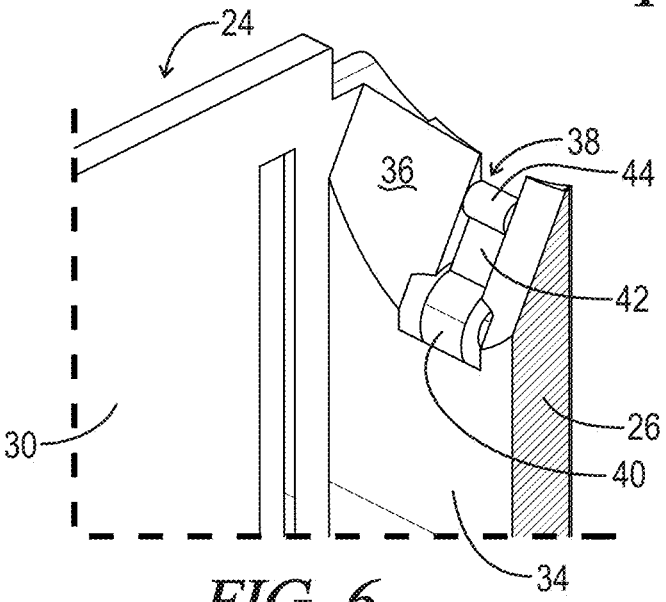
FIG. 6 is an elevated rear right side fragmentary perspective view of the magazine of FIG. 1.
Figure 7:
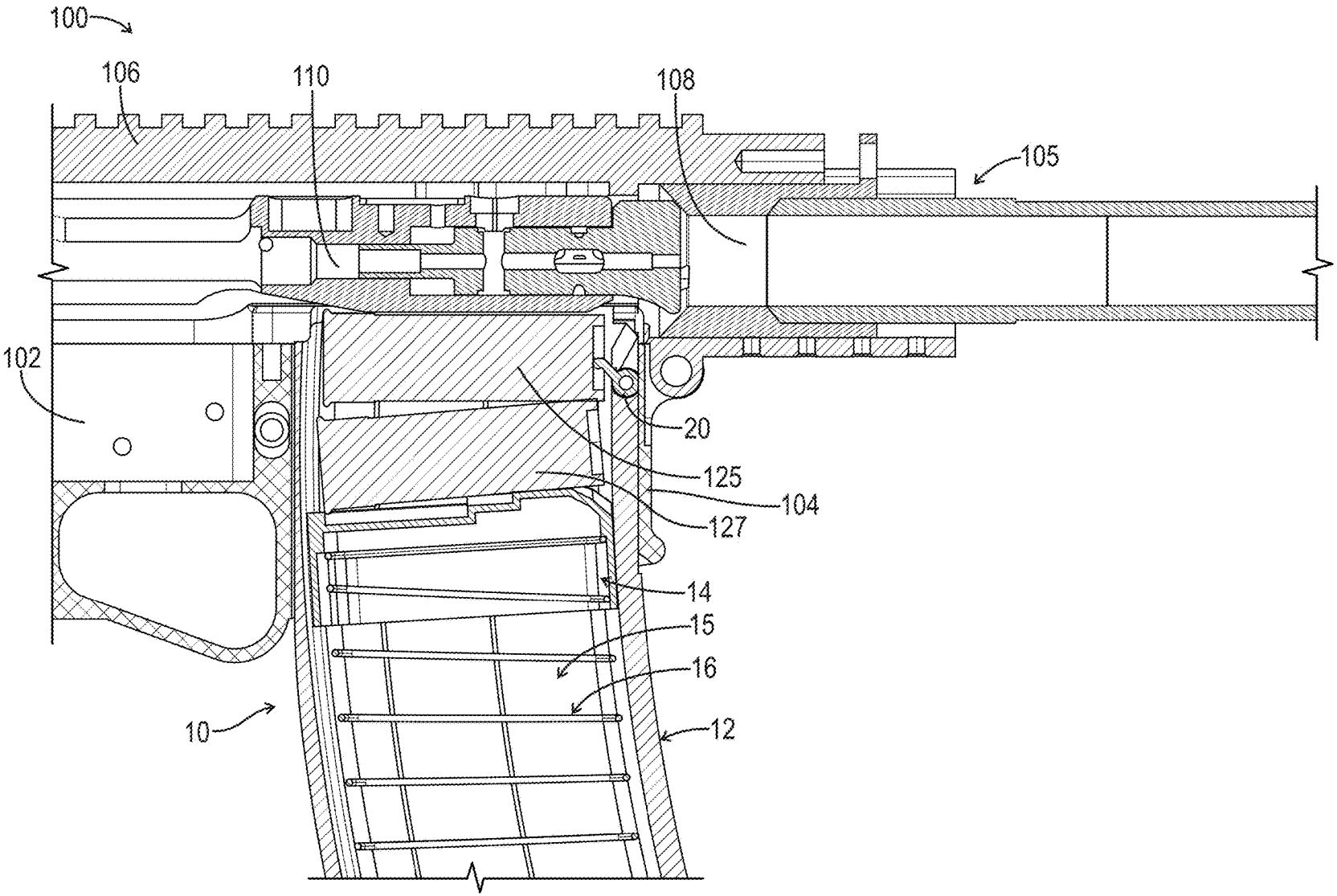
FIG. 7 is a fragmentary longitudinal sectional view of the magazine of FIG. 1 properly seated in a firearm with the bolt carrier group in a first (forwardmost) position.
Figure 8:
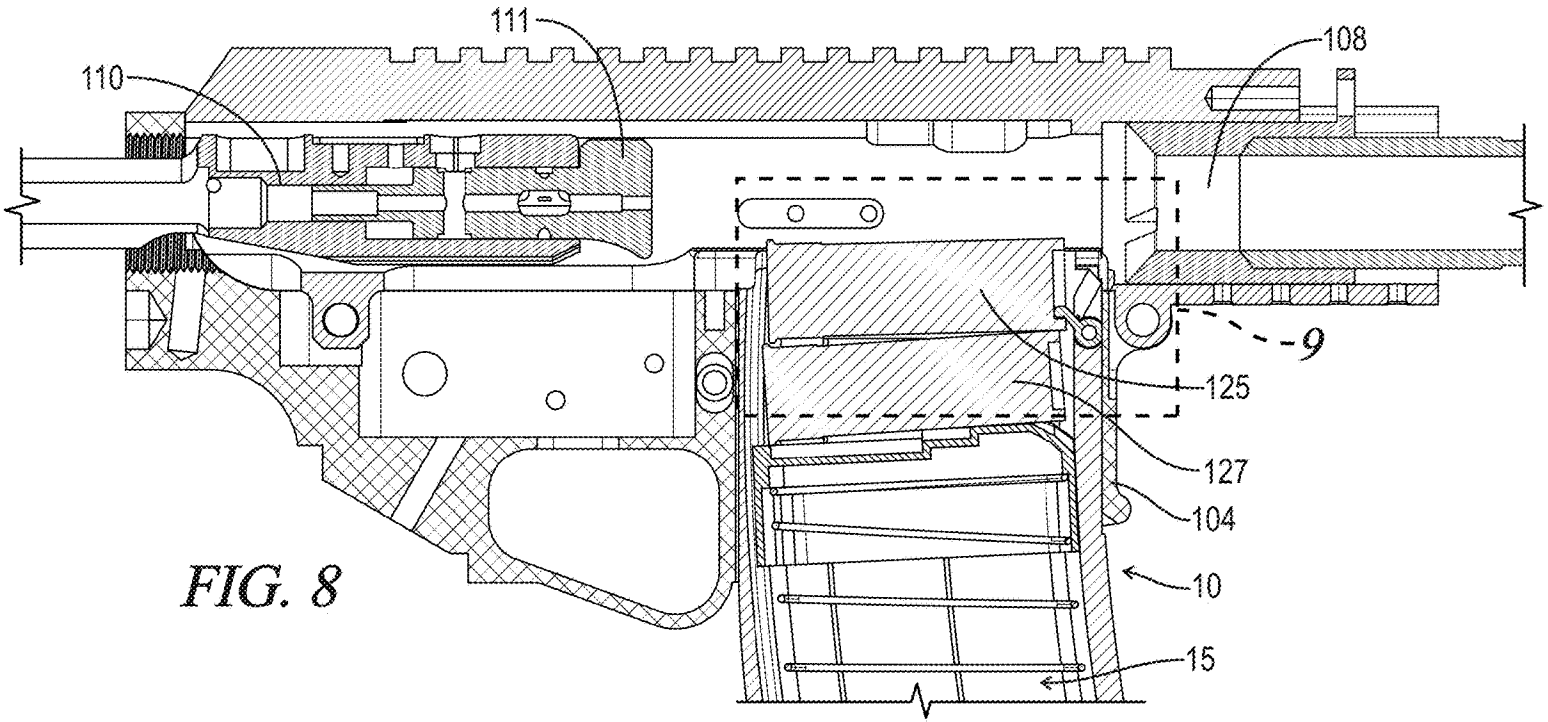
FIG. 8 a longitudinal sectional view of the objects of FIG. 7 with the bolt carrier group in a second (rearmost) position.
Figure 9:
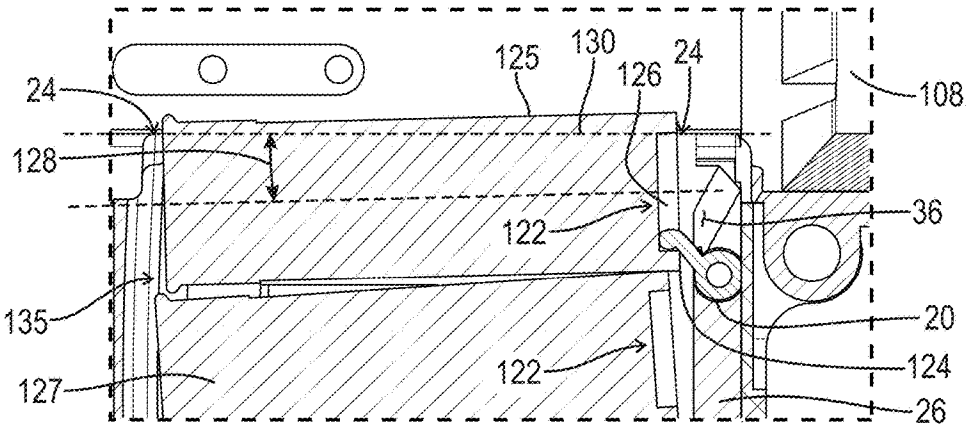
FIG. 9 is magnified detail view of location 9 of FIG. 8.
Figure 10:
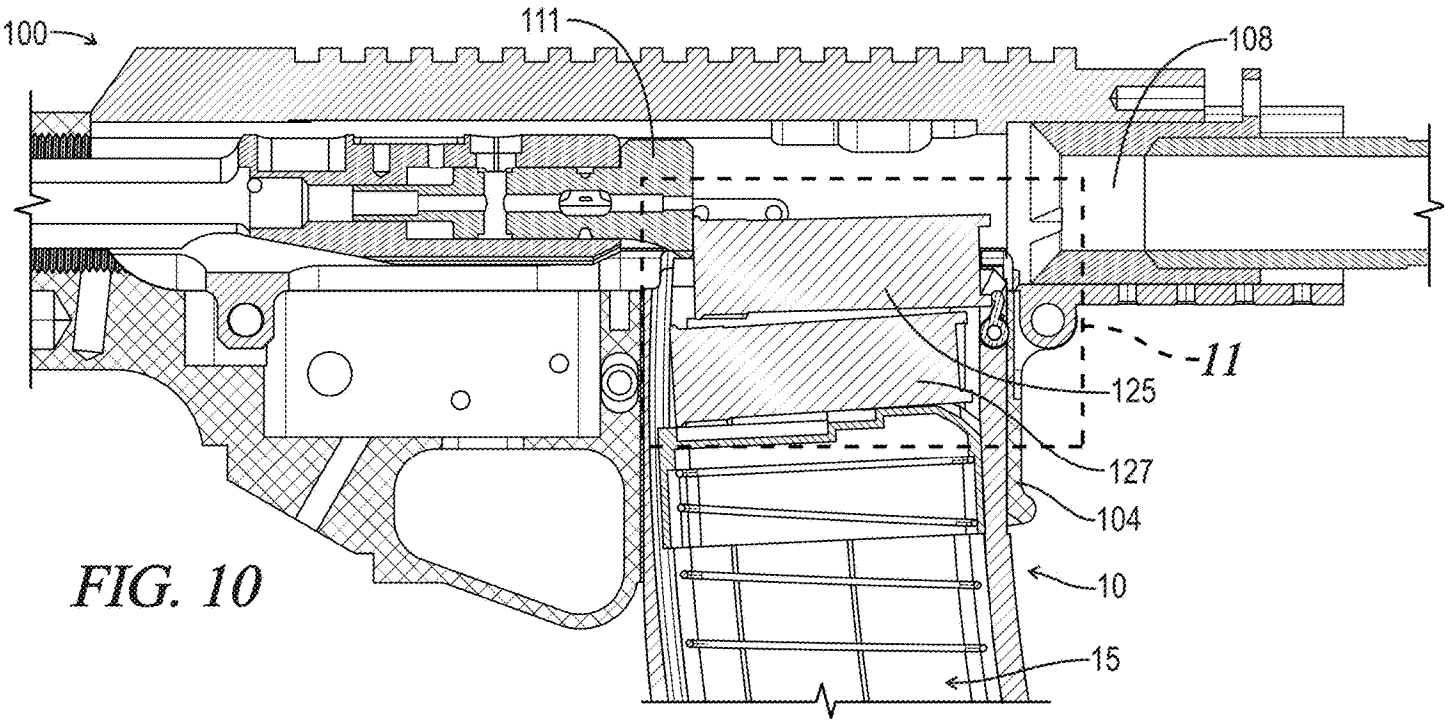
FIG. 10 is a longitudinal sectional view of the objects of FIG. 7 with the bolt carrier group in a third position.
Figure 11:
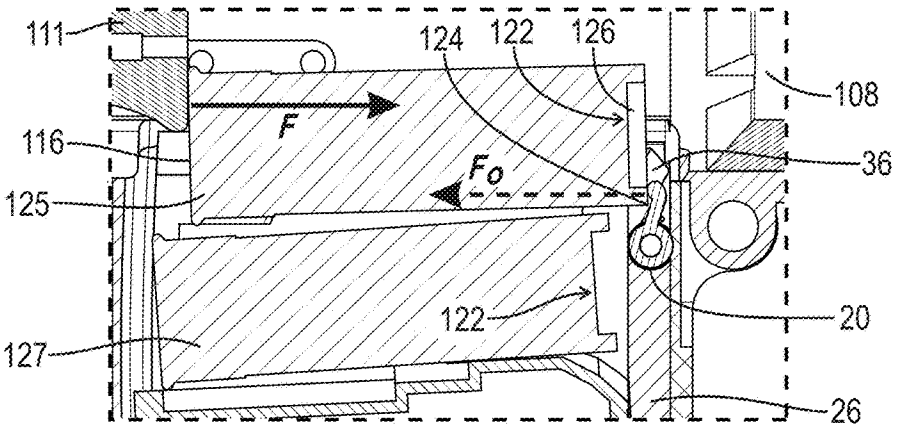
FIG. 11 is magnified detail view of location 11 of FIG. 10.
Figure 12:
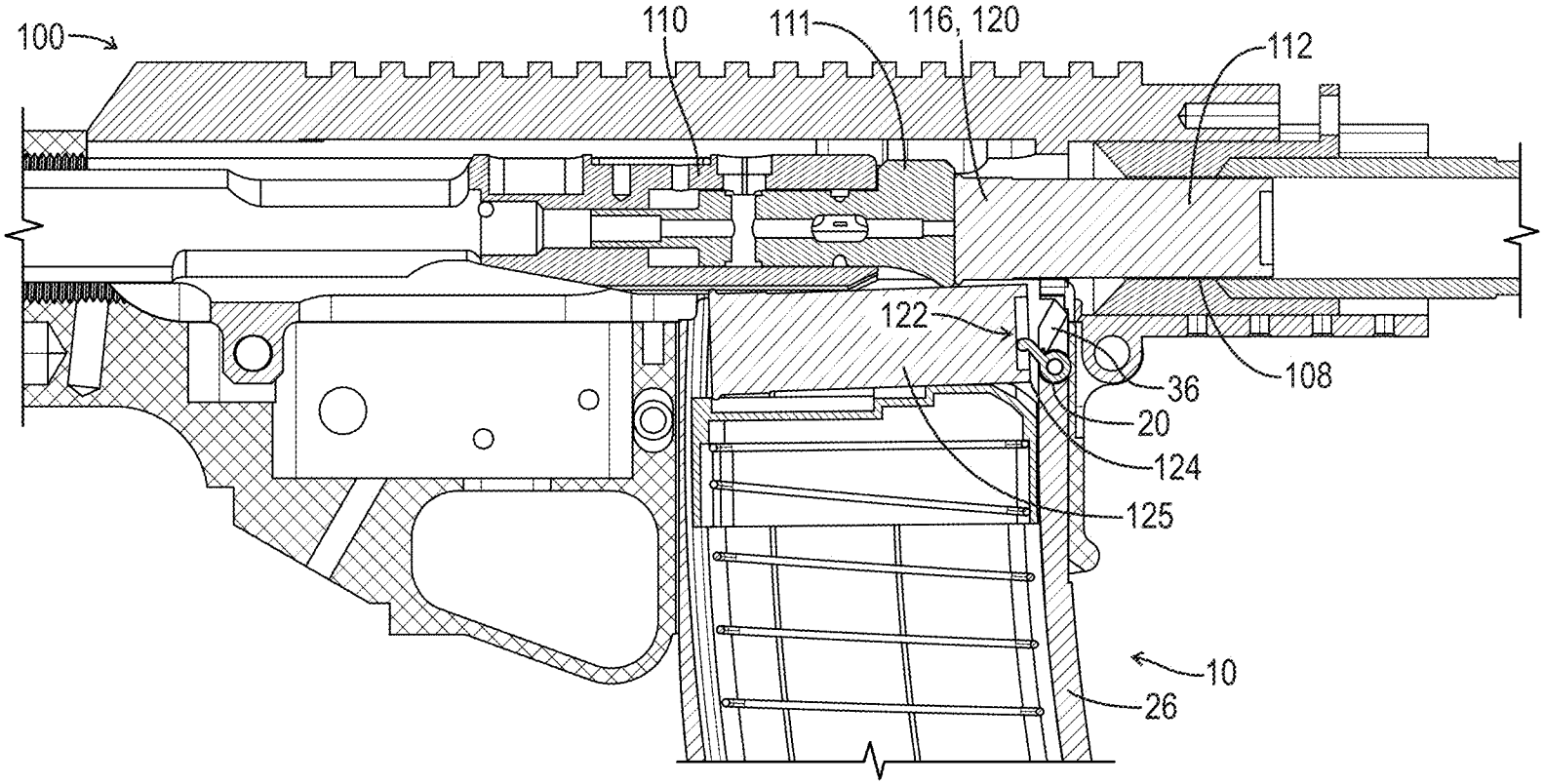
FIG. 12 is a longitudinal sectional view of the objects of FIG. 7 with the bolt carrier group in a fourth position.
Figure 13:
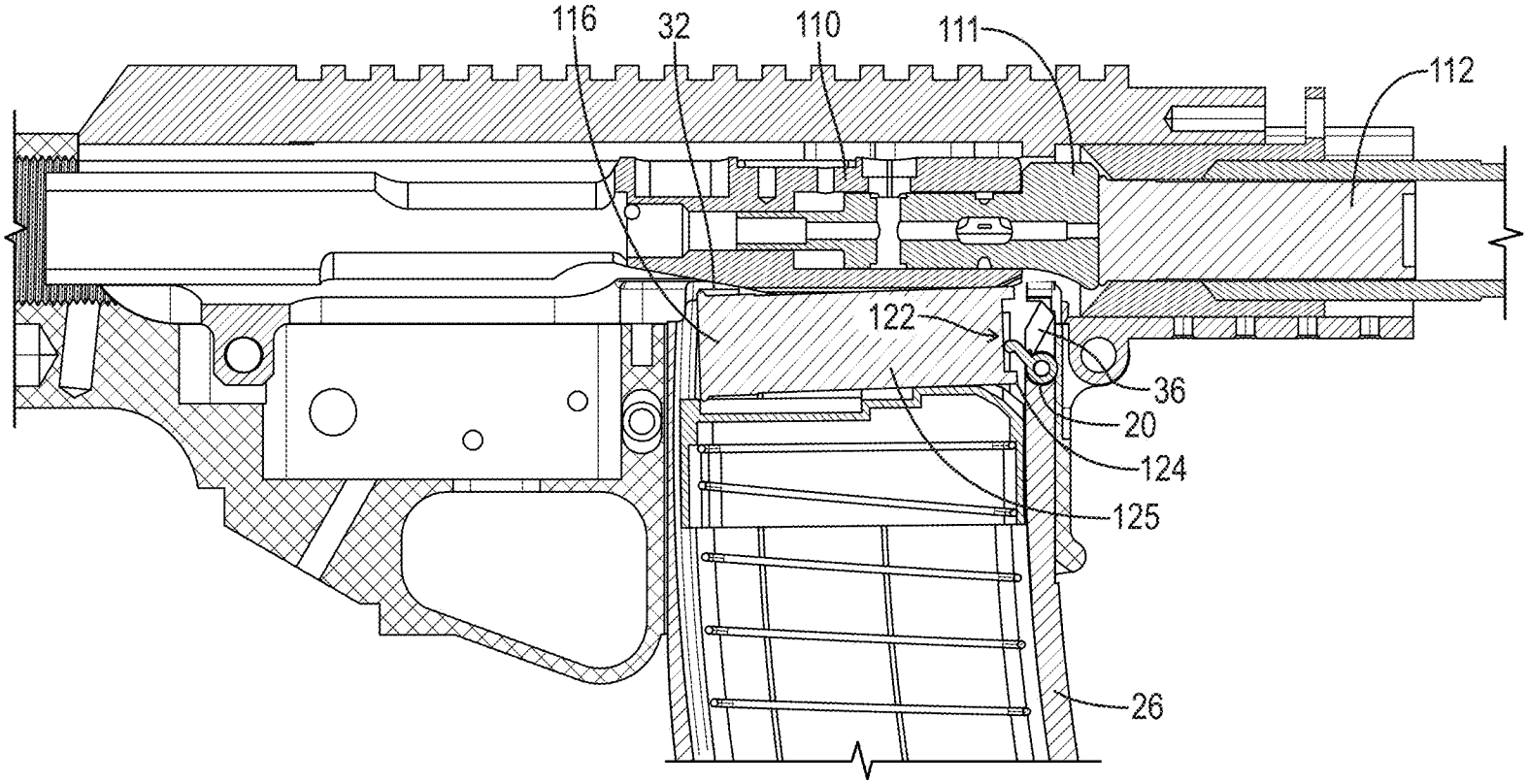
FIG. 13 is a longitudinal sectional view of the objects of FIG. 7 with the bolt carrier group in the first position.

The catch 20 is rotatable between an extended position (e.g., FIGS. 3 and 9) and a retracted position (e.g., FIG. 6). The catch 20 is biased toward the extended position by the spring 46. When the catch 20 is in the extended position, the head 44 engages the front portion 122 of the topmost cartridge 125 to hold the topmost cartridge 125 in the substantially horizontal position 135. In some embodiments, the head 44 engages the crimp or lip 126 on the front portion 122 of the cartridge 125 when the catch 20 is in the extended position. As such, the catch 20 is biased toward engagement with the front portion 122 of the topmost cartridge 125.

When the catch 20 is in the retracted position, the catch 20 does not deter or obstruct movement of the topmost cartridge 125 toward the firing chamber 108. In some embodiments, the catch 20 is recessed into a forward interior surface 32 of the upper end 24 of the magazine body 12 when the catch 20 is in the retracted position. As such, forward wall 26 includes a recess 38 in which the catch 20 is receivable. The recess 38 in which the catch 20 is receivable is defined in the feed ramp 36. Put another way, the feed ramp 36 defines the recess 38 in which the arm 42 and head 44 of the catch 20 are receivable.

Figure 4:
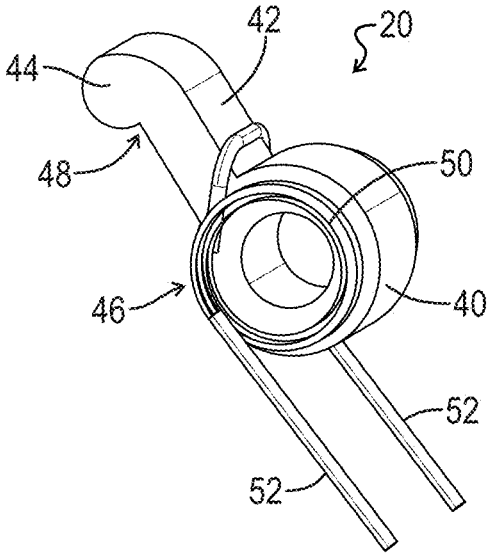
FIG. 4 is a perspective view of the shell catch of FIG. 1 shown in isolation.
Figure 5:
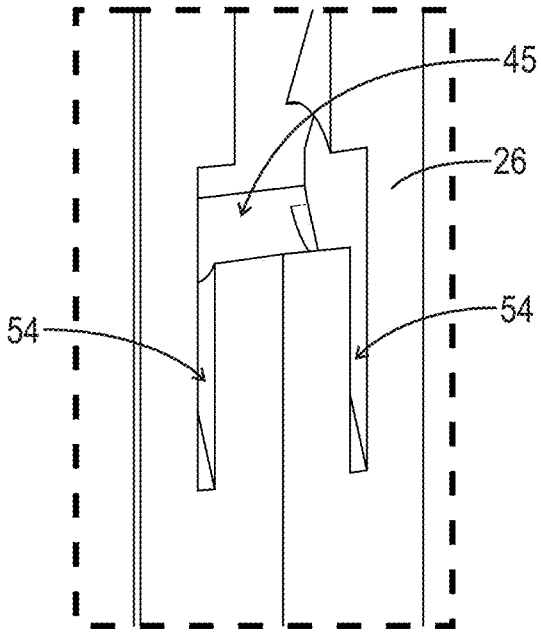
FIG. 5 is a magnified perspective view of location 5 of FIG. 2. The shell catch and cartridges are omitted for clarity.

The catch 20 is configured to rotate out of engagement with the front portion 122 of the topmost cartridge 125, move into the recess 38, and release the topmost cartridge 125 as the advancing bolt 111 pushes the topmost cartridge 125 toward the firing chamber 108. More pointedly, the advancing bolt 111 exerts a force F (indicated by a solid arrow in FIG. 11) greater than an opposing force Fo (indicated by a dashed arrow in FIG. 11) exerted on the catch 20 by the spring 46, and the forward edge 124 of the topmost cartridge 125 rotates the arm 42 and head 44 of the catch 20 into the recess 38 as the topmost cartridge 125 moves up the feed ramp 36 from the interior space 15 and into the firing chamber 108. In some embodiments, the opposing force Fo generated by the spring 46 can result from the coils 50 of the double torsion spring 46 compressing arms 52 thereof as the advancing bolt 111 pushes the forward edge 124 of the topmost cartridge 125 up the feed ramp 36. To this end, the forward wall 26 can include slots 54 in which the arms 52 of the spring 46 are received. The slots 54 intersect the cylindrical pocket 45 so that the arms 52 of the spring 46 are received in the slots 54 when the spring 46 is mounted on the catch 20 with the coils 50 adjacent the catch body 40 as shown in FIG. 4.

In use, cartridges 112 are inserted or loaded into the interior space 15 of the magazine body 12 through the upper end 24 in a manner known to ordinarily skilled artisans. The first inserted cartridge 112 rests against the follower 14. Each subsequent cartridge 112 inserted into the magazine 10 compresses the follower spring 16 and lowers the follower 14 into the interior space 15. The feed lips 32 engage the rear portion 120 of the topmost cartridge 125 while the catch 20 engages the front portion 122 and holds the topmost cartridge 125 within the upper end 24 of the magazine body 12 in the substantially horizontal position 135. The opposing force Fo applied to the catch 20 by the spring 46 causes the catch 20 to press the topmost cartridge 125 against the rear wall 28 of the magazine body 12 under the feed lips 32. Unlike with currently available ammunition magazines, engagement of the front portion 122 of the topmost cartridge 125 by the catch 20 not only maintains the cartridge 125 in the substantially horizontal position 135, but also advantageously prevents the topmost cartridge 125, and thus the following cartridge 127 and any subsequent cartridges 112, from falling out of the upper end 24 of the magazine 10 if the magazine 10 is inadvertently dropped or otherwise jostled.

Once loaded, the magazine 10 is inserted into the magazine well 104 of the firearm 100. Charging the firearm 100 initially moves the bolt carrier group 110 to a rearward position, which places the bolt 111 rearward of the case head 116, then advances the bolt 111 to push the topmost cartridge 125 toward the firing chamber 108 of the barrel assembly 105. As the bolt 111 begins to move the topmost cartridge 125 forward, the rear portion 120 of the cartridge 125 moves out from under the feed lips 32 and the front edge 124 of the topmost cartridge 125 begins to ride up the feed ramp 36. The force F of a buffer spring (not shown) moving the bolt 111 forward is enough to overcome the opposing force Fo of the double torsion spring 48 biasing the catch 20 rearwardly, such that further forward movement of the topmost cartridge 125 allows the forward edge 124 thereof to rotate the catch 20 forwardly into the recess 38 in the feed ramp 36. This allows the front edge 124 to ride all the way up the feed ramp 36 and into the firing chamber 108. Completion of the forward movement of the bolt 111 completes charging by placing the firearm 100 in battery. The topmost cartridge 125 is now chambered and ready to be fired. The following cartridge 127, under pressure of the follower spring 16, is moved upward in the interior space 15 until it contacts the bolt carrier group 110. The catch 20 is also freed to rotate rearwardly into engagement with the front portion 122 of the following cartridge 127.

Upon discharge of the chambered cartridge, the bolt carrier group 110 again moves rearwardly to eject the case 114 of the fired cartridge 112 from the firing chamber 108. The following cartridge 127 moves slightly upward within the interior space 15 to take the position of topmost cartridge 125 resting against the feed lips 32 and the catch 20 in the substantially horizontal position 135. The front end of the topmost cartridge 125 is prevented from moving further up by the catch 20, which prevents the topmost cartridge 125 from interfering with ejection of the previously fired cartridge case 114 and holds the topmost cartridge 125 in the proper position 135 to be pushed forward into the firing chamber 108 by the advancing bolt 111.

Although embodiments of the present invention have been described in detail, it will be understood by those skilled in the art that various modifications can be made therein without departing from the spirit and scope of the invention as set forth in the appended claims. For example, although the catch 20 is described herein as being rotatably mounted to the magazine body 12 and biased toward engagement with the topmost cartridge 125 via a double torsion spring 48, it is to be understood that in some embodiments the catch can take the form of a spring-loaded plunger mounted to the magazine body 12 so as to be linearly retractable via a leaf spring or other compressible elastic means.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific apparatus and methods described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention, it is not intended that such references be construed as limitations upon the scope of this invention except as set forth in the following claims.

What is claimed is:

1. An ammunition magazine for a firearm, comprising:

a magazine body defining an interior space in which a plurality of cartridges is receivable;

a follower in the interior space configured to bias the cartridges toward an upper end of the magazine body; and a catch rotatably mounted to a forward wall of the magazine body, the catch biased rearwardly away from the forward wall and configured to hold a topmost cartridge received in the interior space in a substantially horizontal position within the upper end of the magazine body until an advancing bolt of the firearm pushes the topmost cartridge toward a firing chamber of the firearm.

2. The ammunition magazine of claim 1, wherein the catch is movable between:

an extended position wherein the catch engages a front portion of the topmost cartridge to hold the topmost cartridge in the substantially horizontal position, and a retracted position wherein the catch does not deter movement of the topmost cartridge toward the firing chamber.

3. The ammunition magazine of claim 2, wherein:

the catch is biased toward the extended position; and the advancing bolt exerts a force greater than an opposing force exerted on the catch.

4. The ammunition magazine of claim 1, wherein the catch is movable between:

an extended position wherein the catch engages a front portion of the topmost cartridge to hold the topmost cartridge in the substantially horizontal position, and a retracted position wherein the catch is recessed into a forward interior surface of the upper end of the magazine body.

5. The ammunition magazine of claim 1, wherein:

the catch is biased toward engagement with a front portion of the topmost cartridge; and the catch is configured to rotate out of engagement with the front portion of the topmost cartridge as the advancing bolt pushes the topmost cartridge toward the firing chamber.

6. The ammunition magazine of claim 1, further comprising:

a feed ramp at the upper end of the magazine body; and a recess in which the catch is receivable defined in the feed ramp;

wherein the catch is configured to move into the recess and release the topmost cartridge as the advancing bolt pushes the topmost cartridge toward the firing chamber.

7. The ammunition magazine of claim 1, further comprising:

a pair of feed lips at the upper end of the magazine body configured to engage a rear portion of the topmost cartridge;

wherein the catch is spaced from the pair of feed lips and configured to engage a front portion of the topmost cartridge.

8. The ammunition magazine of claim 1, wherein:

the catch comprises a catch body, an arm extending from the catch body, and a head at an end of the arm opposite the catch body;

the head is configured to engage a front portion of the topmost cartridge; and the arm is biased away from the forward wall into the interior space such that the head engages the front portion of the topmost cartridge to hold the topmost cartridge in the substantially horizontal position.

9. The ammunition magazine of claim 8, wherein:

the forward wall defines a feed ramp on a forward interior surface thereof;

the catch body is rotatably mounted to the forward wall proximate the feed ramp;

the feed ramp defines a recess in which the arm and head of the catch are receivable;

a forward edge of the topmost cartridge rides up the feed ramp when the advancing bolt pushes the topmost cartridge toward the firing chamber; and the forward edge of the topmost cartridge rotates the arm and head of the catch into the recess as the topmost cartridge moves from the interior space into the firing chamber.

10. The ammunition magazine of claim 1, wherein the topmost cartridge is in the substantially horizontal position when the topmost cartridge is at an angle of about 15 degrees or less relative to a horizontal reference plane defined by the upper end of the magazine body.

11. An ammunition magazine for a firearm, comprising:

a magazine body defining an interior space in which a plurality of cartridges is receivable;

a follower in the interior space configured to bias the cartridges toward an upper end of the magazine body;

a pair of feed lips at the upper end of the magazine body configured to engage a rear portion of a topmost cartridge received in the interior space; and a catch rotatably mounted to a forward wall in the upper end of the magazine body, the catch biased rearwardly away from the forward wall and configured to releasably engage a front portion of the topmost cartridge;

wherein the pair of feed lips and the catch are configured to hold the topmost cartridge in a substantially horizontal position within the upper end of the magazine body until an advancing bolt of the firearm pushes the topmost cartridge toward a firing chamber of the firearm.

12. The ammunition magazine of claim 11, wherein the catch is rotatable between:

an extended position wherein the catch engages the front portion of the topmost cartridge to hold the topmost cartridge in the substantially horizontal position, and a retracted position wherein the catch is recessed into a forward interior surface of the upper end of the magazine body.

13. The ammunition magazine of claim 11, wherein:

the catch is biased toward engagement with the front portion of the topmost cartridge; and the catch is configured to rotate out of engagement with the front portion of the topmost cartridge as the advancing bolt pushes the topmost cartridge toward the firing chamber.

14. The ammunition magazine of claim 11, further comprising:

a feed ramp at the upper end of the magazine body; and a recess in which the catch is receivable defined in the feed ramp;

wherein the catch is configured to move into the recess and out of engagement with the front portion of the topmost cartridge as the advancing bolt pushes the topmost cartridge toward the firing chamber.

15. The ammunition magazine of claim 11, wherein:

the catch comprises a catch body, an arm extending from the catch body, and a head at an end of the arm opposite the catch body;

the head is configured to engage the front portion of the topmost cartridge; and the arm is biased into the interior space such that the head engages the front portion of the topmost cartridge to hold the topmost cartridge in the substantially horizontal position with the feed lips.

16. The ammunition magazine of claim 15, wherein:

the forward wall defines a feed ramp on a forward interior surface thereof;

the catch body is rotatably mounted to the forward wall proximate the feed ramp;

the feed ramp defines a recess in which the arm and head of the catch are receivable;

a forward edge of the topmost cartridge rides up the feed ramp when the advancing bolt pushes the topmost cartridge toward the firing chamber; and the forward edge of the topmost cartridge rotates the arm and head of the catch into the recess as the topmost cartridge moves from the interior space into the firing chamber.

17. The ammunition magazine of claim 11, wherein the topmost cartridge is in the substantially horizontal position when the topmost cartridge is at an angle of about 15 degrees or less relative to a horizontal reference plane defined by the upper end of the magazine body.

18. An ammunition magazine for a firearm, comprising:

a magazine body defining an interior space in which a plurality of cartridges is receivable; a spring-loaded follower in the interior space configured to bias the cartridges toward an upper end of the magazine body;

a feed ramp on a forward interior surface of the upper end of the magazine body;

a pair of feed lips at the upper end of the magazine body spaced from the feed ramp; and a spring-loaded catch rotatably mounted to a forward wall of the magazine body proximate the feed ramp, the catch biased rearwardly away from the forward wall;

wherein the pair of feed lips and the catch are configured to hold the topmost cartridge within the upper end of the magazine body at an angle of about 15 degrees or less relative to a horizontal reference plane defined by the upper end of the magazine body until an advancing bolt of the firearm pushes the topmost cartridge up the feed ramp and toward a firing chamber of the firearm.

19. The ammunition magazine of claim 18, wherein:

the firearm is a shotgun;

the cartridges are shotshells;

the feed lips are configured to engage a case head of the topmost shotshell; and the catch is configured to engage a crimp or lip of the topmost shotshell.

* * * * *